US006510906B1

(12) United States Patent
Richert et al.

(10) Patent No.: US 6,510,906 B1
(45) Date of Patent: Jan. 28, 2003

(54) IMPREGNATED BIT WITH PDC CUTTERS IN CONE AREA

(75) Inventors: Volker Richert, Celle/Gross-Hehlen (DE); Van J. Brackin, Spring, TX (US); Matthew R. Isbell, Houston, TX (US); Douglas J. Bobrosky, Calgary (CA)

(73) Assignee: Baker Hughes Incorporated, Houston, TX (US)

( * ) Notice: Subject to any disclaimer, the term of this patent is extended or adjusted under 35 U.S.C. 154(b) by 12 days.

(21) Appl. No.: 09/709,999

(22) Filed: Nov. 10, 2000

Related U.S. Application Data

(60) Provisional application No. 60/167,781, filed on Nov. 29, 1999.

(51) Int. Cl.[7] ..... E21B 10/46

(52) U.S. Cl. ..... 175/39; 175/375; 175/379; 175/428; 175/434

(58) Field of Search ..... 175/379, 374, 175/375, 398–400, 428, 434, 39

(56) References Cited

U.S. PATENT DOCUMENTS

| | | | | |
|---|---|---|---|---|
| 4,776,411 A | | 10/1988 | Jones | |
| 4,794,994 A | | 1/1989 | Deane et al. | |
| 4,813,500 A | * | 3/1989 | Jones | 175/329 |
| 4,848,489 A | | 7/1989 | Deane | |
| 4,907,662 A | | 3/1990 | Deane et al. | |
| 4,991,670 A | | 2/1991 | Fuller et al. | 175/329 |
| 5,033,559 A | * | 7/1991 | Fischer | 175/329 |
| 5,582,261 A | | 12/1996 | Keith et al. | |
| 5,722,499 A | | 3/1998 | Nguyen et al. | |
| 5,732,784 A | | 3/1998 | Nelson | |
| 6,003,623 A | * | 12/1999 | Miess | 175/430 |
| 6,009,962 A | | 1/2000 | Beaton | |
| 6,021,858 A | | 2/2000 | Southland | |
| 6,062,325 A | | 5/2000 | Taylor et al. | |
| 6,095,265 A | | 8/2000 | Alsup | |
| 6,142,250 A | * | 11/2000 | Griffin et al. | 175/381 |
| 6,216,805 B1 | * | 4/2001 | Lays et al. | 175/374 |
| 6,296,069 B1 | | 10/2001 | Lamine et al. | |

FOREIGN PATENT DOCUMENTS

| | | |
|---|---|---|
| EP | 0 418 706 A1 | 4/1987 |
| FR | 2 375 428 | 5/1976 |
| GB | 2 347 957 A | 9/2000 |
| GB | 2 353 053 A | 2/2001 |
| WO | 97/48877 | 12/1997 |
| WO | 98/27311 | 6/1998 |

OTHER PUBLICATIONS

Belgian Search Report of Jul. 19, 2002.

* cited by examiner

*Primary Examiner*—David Bagnell
*Assistant Examiner*—Zakiya Walker
(74) *Attorney, Agent, or Firm*—TraskBritt

(57) ABSTRACT

A drill bit employing a plurality of discrete, post-like diamond grit impregnated cutting structures extending upwardly from abrasive particulate-impregnated blades defining a plurality of fluid passages therebetween on the bit face. PDC cutters with faces oriented in the general direction of bit rotation are placed in the cone of the bit, which is relatively shallow, to promote enhanced drilling efficiency through softer, non-abrasive formations. A plurality of ports, configured to receive nozzles therein are employed for improved drilling fluid flow and distribution. The blades may extend radially in a linear fashion, or be curved and spiral outwardly to the gage to provide increased blade length and enhanced cutting structure redundancy.

54 Claims, 4 Drawing Sheets

IMPREGNATED BIT WITH PDC CUTTERS IN CONE AREA

RELATED APPLICATIONS

This application claims the benefit of U.S. Provisional Patent Application Serial No. 60/167,781, filed Nov. 29, 1999 for IMPREGNATED BIT WITH PDC CUTTERS IN CONE AREA.

BACKGROUND OF THE INVENTION

1. Field of the Invention

The present invention relates to fixed cutter or drag type bits for drilling subterranean formations. More specifically, the present invention relates to drag bits for drilling hard and/or abrasive rock formations, and especially for drilling such formations interbedded with soft and non-abrasive layers.

2. State of the Art

So-called "impregnated" drag bits are used conventionally for drilling hard and/or abrasive rock formations, such as sandstones. The impregnated drill bits typically employ a cutting face composed of superhard cutting elements, such as natural or synthetic diamond grit, dispersed within a matrix of wear resistant material. As such a bit drills, the matrix and diamonds wear, worn cutting elements are lost and new cutting elements are exposed. These diamond elements may either be natural or synthetic, and may be cast integral with the body of the bit, as in low-pressure infiltration, or may be preformed separately, as in hot isostatic pressure infiltration, and attached to said bit by brazing or furnaced to bit during manufacturing.

Conventional impregnated bits generally exhibit poor hydraulics design by employing a crow's foot to distribute drilling fluid across the bit face and providing only minimal flow area. Further, conventional impregnated bits do not drill effectively when the bit encounters softer and less abrasive layers of rock, such as shales. When drilling through shale, or other soft formations, with a conventional impregnated drag bit the cutting structure tends to quickly clog or "ball up" with formation material making the drill bit ineffective. The softer formations can also plug up fluid courses formed in the drill bit causing heat build up and premature wear of the bit. Therefore, when shale type formations are encountered, a more aggressive bit is desired to achieve a higher rate of penetration (ROP). It follows, therefore, that selection of a bit for use in a particular drilling operation becomes more complicated when it is expected that formations of more than one type will be encountered during the operation.

Thus it would be beneficial to design a drill bit which would perform more aggressively in softer less abrasive formations while also providing adequate ROP in harder more abrasive formations without requiring increased WOB during the drilling process.

BRIEF SUMMARY OF THE INVENTION

The present invention comprises a rotary drag bit employing impregnated cutting elements in the form of discrete, post-like, mutually separated cutting structures projecting upwardly from radially extending blades on the bit face, the blades defining fluid passages therebetween extending to junk slots on the bit gage. The cone portion, or central area of the bit face, is of a relatively shallow configuration and is provided with superabrasive cutters in the form of polycrystalline diamond compacts (PDCs) having cutting faces facing generally in the direction of bit rotation. The PDC cutters provide superior performance in interbedded and shaley formations. Bit hydraulics is enhanced by the aforementioned fluid passages, which are provided with drilling fluid by a plurality of nozzles located in ports distributed over the bit face for enhanced volume and apportionment of drilling fluid flow.

In one embodiment, the blades extend generally radially outwardly in a linear fashion from locations within the cone at the centerline of the bit (in the case of blades carrying the PDC cutters in the cone), within the cone but not at the centerline, or at the edge of the cone, to the gage of the bit, where contiguous gage pads extend longitudinally and define junk slots therebetween. In another embodiment, the blades are curved and extend generally radially outwardly in a spiral fashion from the centerline (again, in the case of the blades carrying PDC cutters), within the cone, or at the edge of the cone, to the gage of the bit and contiguous with longitudinally extending gage pads defining junk slots therebetween. The elongated nature of the spiraled blades provides additional length for carrying the discrete cutting structures so as to enhance redundancy thereof at any given radius.

DETAILED DESCRIPTION OF THE INVENTION

Figure 1:
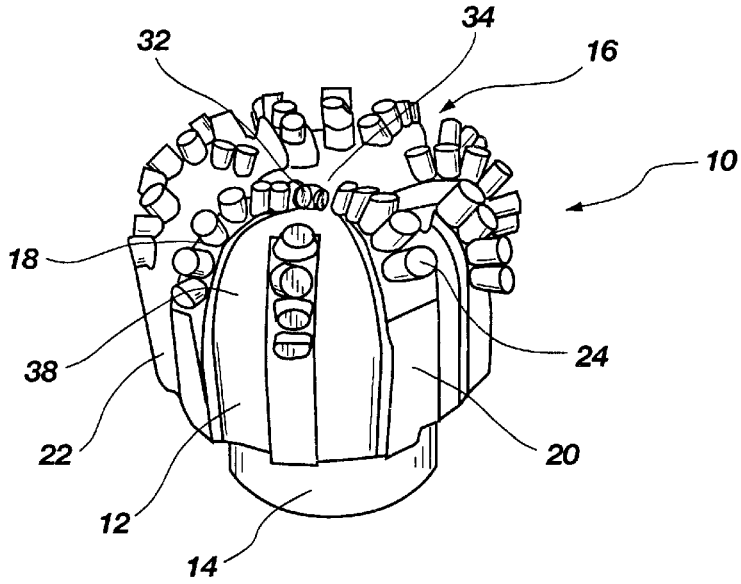
FIG. 1 comprises an inverted perspective view of a first embodiment of a bit of the present invention.
Figure 2A:
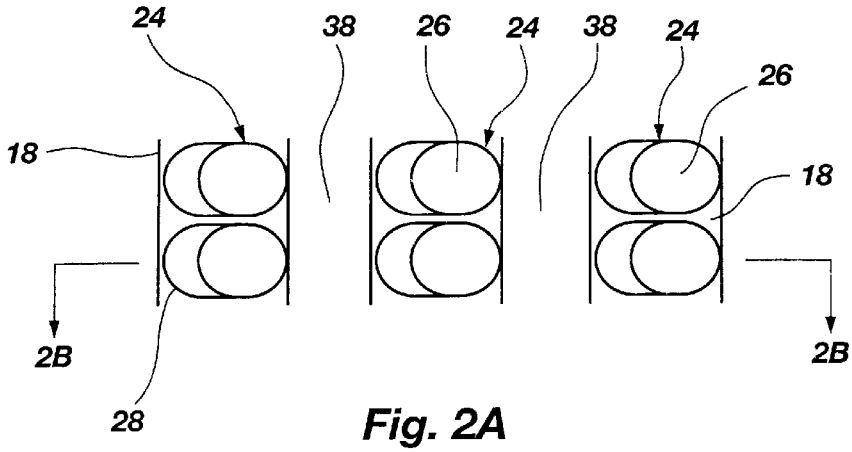
FIG. 2A is a schematic top elevation of portions of a plurality of blades of the bit of FIG. 1 carrying discrete cutting structure and FIG. 2B is a side sectional elevation taken across line B—B of FIG. 2A.
Figure 2B:
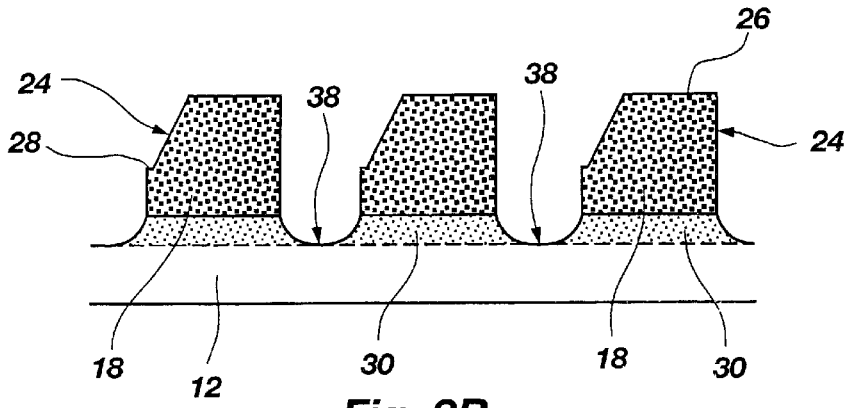
Figure 3:
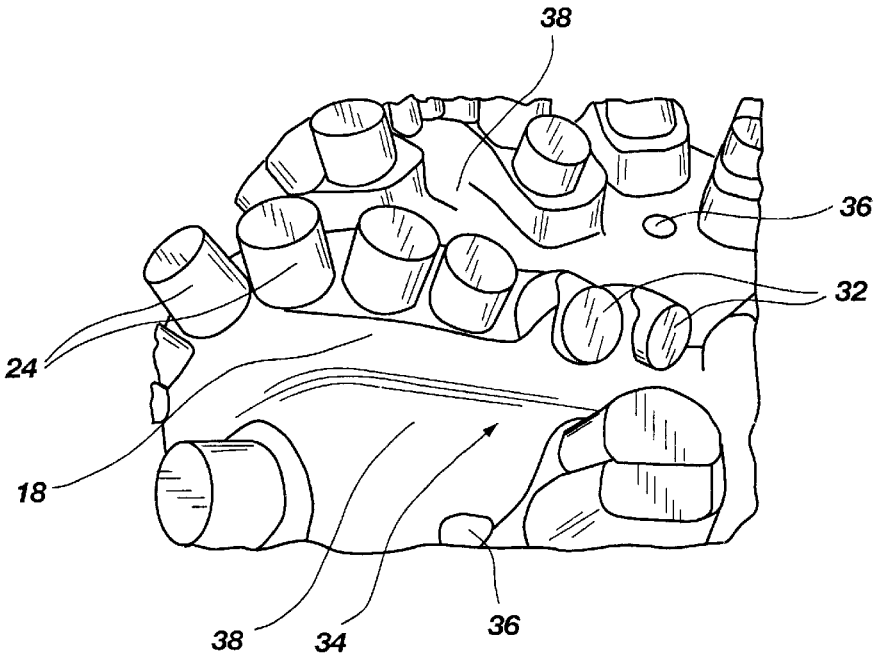
FIG. 3 is an enlarged, inverted perspective view of part of the cone portion of the face of the bit of FIG. 1, showing wear of discrete, diamond grit-impregnated cutting structures and PDC cutters.

Referring now to FIGS. 1–3 of the drawings, a first embodiment 10 the bit of the present invention is depicted in perspective, bit 10 being inverted from its normal face-down operating orientation for clarity. Bit 10 is, by way of example only, of 8½" diameter and includes a matrix-type bit body 12 having a shank 14 for connection to a drill string (not shown) extending therefrom opposite bit face 16. A plurality of (in this instance, twelve (12)) blades 18 extend generally radially outwardly in linear fashion to gage pads 20 defining junk slots 22 therebetween.

Unlike conventional impregnated bit cutting structures, the discrete, impregnated cutting structures 24 comprise posts extending upwardly (as shown in FIG. 1) on blades 18 from the bit face 16. The cutting structures are formed as an integral part of the matrix-type blades 18 projecting from a matrix-type bit body 12 by hand-packing diamond-grit impregnated matrix material in mold cavities on the interior of the bit mold defining the locations of the cutting structures 24 and blades 18. It is noted that the cutting structures 24 could be placed directly on the bit face 16, dispensing with the blades. However, as discussed in more detail below, it is preferable to have the cutting structures 24 located on the blades 18. It is also noted that, while discussed in terms of being integrally formed with the bit 10, the cutting structures 24 may be formed as discrete individual segments, such as by hot isostatic pressure, which are subsequently brazed or furnaced onto the bit 10.

Discrete cutting structures 24 are mutually separate from each other, to promote drilling fluid flow therearound for enhanced cooling and clearing of formation material removed by the diamond grit. Discrete cutting structures 24, as shown in FIG. 1, are generally of a round or circular transverse cross-section at their substantially flat, outermost ends 26, but become more oval with decreasing distance from the face of the blades 16 and thus provide wider or more elongated (in the direction of bit rotation) bases 28 (see FIGS. 2A and 2B) for greater strength and durability. As the discrete cutting structures 24 wear (see FIG. 3), the exposed cross-section of the posts increases, providing progressively increasing contact area for the diamond grit with the formation material. As the cutting structures wear down, the bit 10 takes on the configuration of a heavier set bit more adept at penetrating harder, more abrasive formations. Even if discrete cutting structures 24 wear completely away, the diamond-impregnated blades 18 will provide some cutting action, reducing any possibility of ring-out and having to pull the bit 10.

While the cutting structures 24 are illustrated as exhibiting posts of circular outer ends and oval shaped bases, other geometries are also contemplated. For example, while not depicted in the drawings, the outermost ends 26 of the cutting structures may be configured as ovals having a major diameter and a minor diameter. The base portion adjacent the blade 18 might also be oval having a major and a minor diameter wherein the base has a larger minor diameter than the outermost end 26 of the cutting structure 24. As the cutting structure 24 wears towards the blade 18 the minor diameter increases resulting in a larger surface area. Furthermore, the ends of the cutting structures 24 need not be flat, but may employ sloped geometries. In other words, the cutting structures 24 may change cross sections at multiple intervals, and tip geometry may be separate from the general cross section of the cutting structure. Other shapes or geometries may be configured similarly. It is also noted that the spacing between individual cutting structures 24, as well as the magnitude of the taper from the outermost ends 26 to the blades 18, may be varied to change the overall aggressiveness of the bit 10 or to change the rate at which the bit is transformed from a light set bit to a heavy set bit during operation. It is further contemplated that one or more of such cutting structures 24 may be formed to have a substantially constant cross-sections if so desired depending on the anticipated application of the bit 10.

Discrete cutting structures 24 may comprise a synthetic diamond grit, such as DSN-47 Synthetic diamond grit, commercially available from DeBeers of Shannon, Ireland, which has demonstrated superior toughness to natural diamond grit. The tungsten carbide matrix material with which the diamond grit is mixed to form discrete cutting structures 24 and supporting blades 18 is preferably a fine grain carbide, such as, for example, DM2001 powder commercially available from Kennametal Inc., of Latrobe, Pa. Such a carbide powder, when infiltrated, provides increased exposure of the diamond grit particles in comparison to conventional matrix materials due to its relatively soft, abradable nature. The base 30 of each blade is preferably formed of a more durable 121 matrix material, obtained from Firth MPD of Houston, Tex. Use of the more durable material in this region helps to prevent ring-out even if all of the discrete cutting structures 24 and the majority of each blade 18 was worn.

It is noted, however, that alternative particulate abrasive materials may be suitably substituted for those discussed above. For example, the discrete cutting structures 24 may include natural diamond grit, a combination of synthetic and natural diamond grit. Alternatively, the cutting structures may include synthetic diamond pins.

Figure 4:
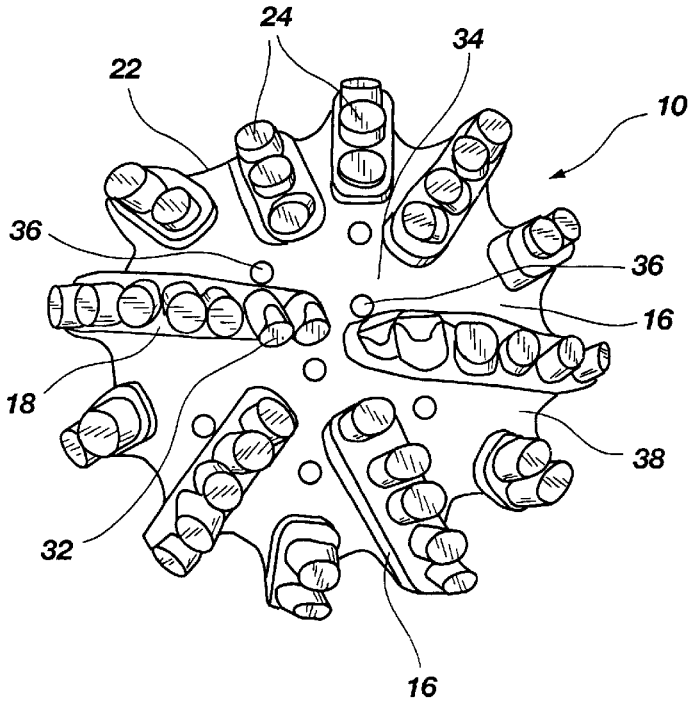
FIG. 4 is a top elevation of the bit of FIG. 1 after testing, showing wear of the discrete cutting structures and PDC cutters.

Referring now to FIG. 4, the radially innermost ends of two blades 18 extend to the centerline of bit 10 and carry PDC cutters 32 in conventional orientations, with cutting faces oriented generally facing the direction of bit rotation. PDC cutters 32 are located within the cone portion 34 of the bit face 16. The cone 34, best viewed with reference to FIG. 1, is the portion of the bit face 16 wherein the profile is defined as a generally cone shaped section about the centerline of intended rotation of the drill bit 10. While both discrete cutting structures 24 and PDC cutters 32 are carried by the bit, as is apparent in FIGS. 1 and 4, there is desirably a greater quantity of the discrete cutting structures 24 than there are PDC cutters 32.

The PDC cutters may comprise cutters having a PDC jacket or sheath extending contiguously with, and to the rear of, the PDC cutting face and over the supporting substrate. For example, a cutter of this type is offered by Hughes Christensen Company, a wholly-owned subsidiary of the assignee of the present invention, as Niagara™ cutters. Such cutters are further described in U.S. patent application Ser. No. 09/205,138, now U.S. Pat. No. 6,401,844 entitled CUTTER WITH COMPLEX SUPERABRASIVE GEOMETRY AND DRILL BITS SO EQUIPPED. This cutter design provides enhanced abrasion-resistance to the hard and/or abrasive formations typically drilled by impregnated bits, in combination with enhanced performance (ROP) in softer, non-abrasive formation layers interbedded with such hard formations. It is noted, however, that alternative PDC cutter designs may be implemented. Rather, PDC cutters 32 may be configured of various shapes, sizes, or materials as known by those of skill in the art.

Again referring to FIG. 4 of the drawings, bit 10 employs a plurality (in this instance, eight (8)) ports 36 over the bit face 16 to enhance fluid velocity of drilling fluid flow and better apportion the flow over the bit face 16 and among fluid passages 38 between blades 18 and extending to junk slots 22. This enhanced fluid velocity and apportionment helps prevent bit balling in shale formations, for example, which phenomenon is known to significantly retard ROP. Further, in combination with the enhanced diamond exposure of bit 10, the improved hydraulics substantially enhances drilling through permeable sandstones.

Still referring to FIG. 4, an example of employing a conventional impregnated bit gage design in accordance with the present invention is disclosed. By way of illustration only, the gage pads of the illustrated embodiment may be approximately 3 inches long each comprising approximately 1.5 inches of thermally stable product (TSP) diamond and diamond grit-impregnated matrix, and approximately 1.5 inches of carbide bricks and K-type natural diamonds. Such an arrangement may likewise be applied to bits of differing diameters.

In operation, bit 10 according to the present invention would be run into a well and "broken-in" or "sharpened" by drilling into an abrasive formation at a selected WOB as the bit is rotated. For the first several feet of penetration, the diamond grit on the ends of the posts forming discrete cutting structures 24 becomes more exposed, as no substantial volume of diamond is usually exposed on an impregnated bit as manufactured. Once the bit has been "sharpened" to expose the diamond grit at the outer ends 26 of discrete cutting structures 24, ROP stabilizes. It has been demonstrated in testing on a full scale laboratory drilling simulator that the inventive bit may exhibit an increased ROP over conventional impregnated bits. It has likewise been shown that the inventive bit may exhibit a substantially similar ROP to that of a conventional impregnated bit but at a reduced WOB.

Figure 5:
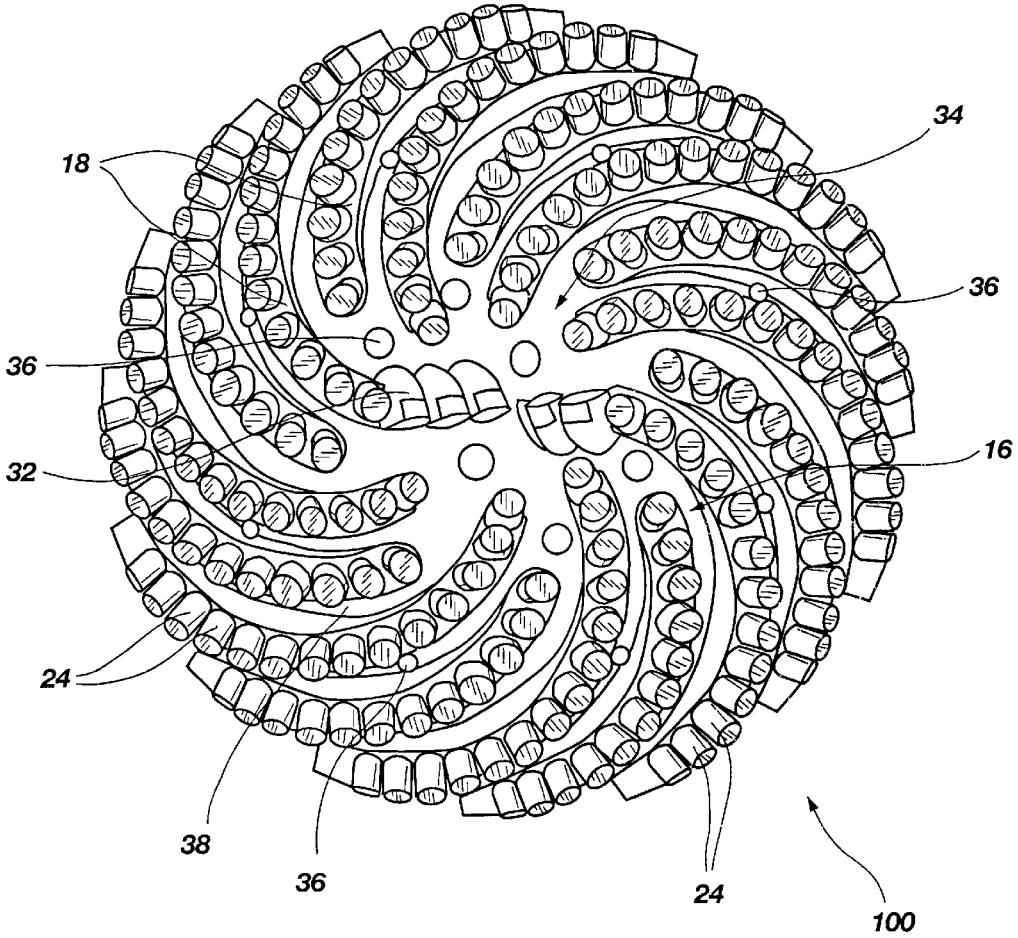
FIG. 5 is a top elevation of a second embodiment of the bit of the present invention.
Figure 6:
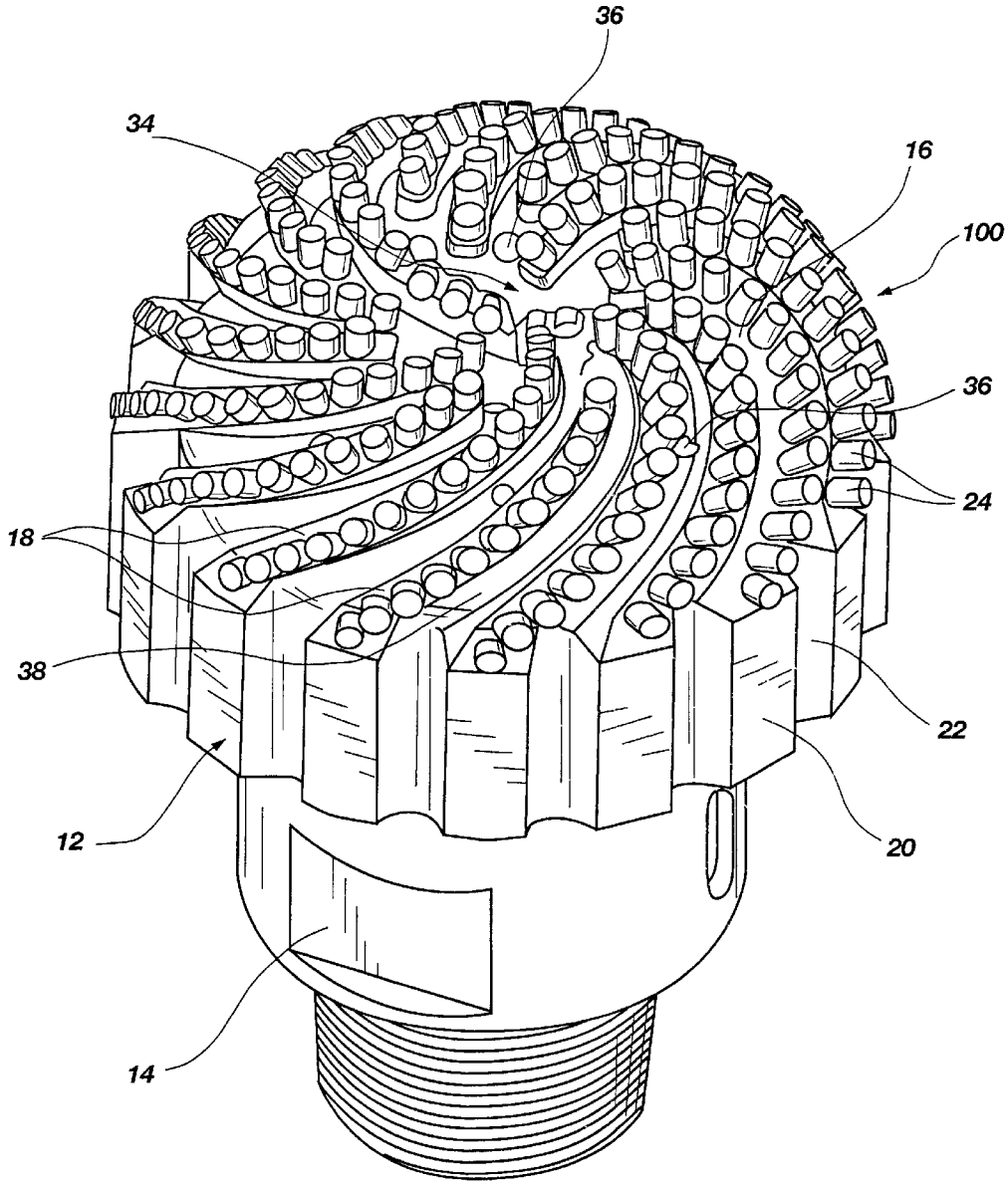
FIG. 6 is an inverted perspective view of the bit of FIG. 5.

Referring now to FIGS. 5 and 6 of the drawings, another embodiment 100 of the bit according to the invention is depicted. Features previously described with reference to bit 10 are identified with the same reference numerals on bit 100. It will be noted that there is a larger number of blades 18 on bit 100 than on bit 10, and that the blades 18 spiral outwardly from the cone 34 of bit 100 toward the gage. The use of the curved, spiraled blades 18 provides increased blade length and thus greater redundancy of coverage of discrete cutting structures 24 at each radius. It should also be noted that there are a larger number of ports 36 on bit face 16 for fluid distribution typically through nozzles (not shown) installed in the ports 36. The ports 36 within the cone 34 are preferably of larger diameter than those outside of the cone 34. Alternatively, the blades 16 may be formed in other shapes or patterns. For example, the blades may be formed to extend outwardly from the cone 34 in a serpentine fashion, each blade forming an "S" shape as it travels across the bit face 16 toward the gage 20.

While the bit of the present invention has been described with reference to certain preferred embodiments, those of ordinary skill in the art will recognize and appreciate that it is not so limited. Additions, deletions and modifications to the embodiments illustrated and described herein may be made without departing from the scope of the invention as defined by the claims herein. Similarly, features from one embodiment may be combined with those of another.

What is claimed is:

1. A rotary drag bit for drilling subterranean formations, comprising:

a bit body having a face extending from a centerline to a gage, the face including a cone portion surrounding the centerline;

a plurality of blades on the face extending generally radially outwardly toward the gage;

a plurality of discrete, mutually separated cutting structures comprising a particulate abrasive material protruding upwardly from each of the blades; and a plurality of polycrystalline diamond compact (PDC) cutters disposed on the face within the cone portion, wherein there is a greater quantity of discrete mutually separated cutting structures than PDC cutters.

2. The rotary drag bit of claim 1, wherein the discrete cutting structures and the blades are integrally formed.

3. The rotary drag bit of claim 1, wherein the particulate comprises synthetic diamond grit.

4. The rotary drag bit of claim 1, wherein the particulate comprises natural diamond grit.

5. The rotary drag bit of claim 1, wherein the discrete cutting structures are configured as posts.

6. The rotary drag bit of claim 5, wherein the posts include bases of larger cross-sectional area than outermost ends thereof.

7. The rotary drag bit of claim 6, wherein the posts taper from substantially circular outermost ends to substantially oval bases.

8. The rotary drag bit of claim 5, wherein the posts exhibit a constant cross-sectional area.

9. The rotary drag bit of claim 1, wherein at least one of the plurality of discrete cutting structures is formed as a hot isostatic segment.

10. The rotary drag bit of claim 9, wherein the at least one discrete cutting structure is brazed onto the blade.

11. The rotary drag bit of claim 1, further including a plurality of ports opening onto the bit face and in communication with a plurality of fluid passages respectively disposed between the blades.

12. The rotary drag bit of claim 1, wherein at least one of the blades extends to a location proximate the centerline, and the PDC cutters are carried by the at least one blade.

13. The rotary drag bit of claim 12, wherein two of the blades extend to locations proximate the centerline wherein at least one PDC cutter is carried on each of the extended blades.

14. The rotary drag bit of claim 1, wherein the bit body comprises a matrix bit body, and the blades are integral with the bit body.

15. The rotary drag bit of claim 14, wherein the discrete cutting structures are integral with the blades and the bit body.

16. The rotary drag bit of claim 15, wherein the discrete cutting structures are comprised of a metal matrix material carrying the diamond grit and at least a portion of the blades is comprised of a softer and more abradable metal matrix material than that of the metal matrix material present in bases of the blades.

17. The rotary drag bit of claim 14, wherein the discrete cutting structures are brazed onto the blades.

18. The rotary drag bit of claim 14, wherein the discrete cutting structures are funaced onto the blades.

19. The rotary drag bit of claim 1, wherein the PDC cutters are oriented with cutting faces substantially facing in a direction of intended bit rotation.

20. The rotary drag bit of claim 19, wherein the PDC cutters include PDC sheaths contiguous with, and extending to the rear of, the cutting faces, taken in the direction of intended bit rotation, extending over substrates of the PDC cutters.

21. The rotary drag bit of claim 1, wherein the blades extend radially outwardly over the bit face in substantially linear fashion.

22. The rotary drag bit of claim 1, wherein the blades extend radially outwardly in spiral fashion.

23. The rotary drag bit of claim 1, wherein the blades extend radially outwardly in a serpentine fashion.

24. A rotary drag bit for drilling subterranean formations, comprising:

a bit body having a face extending from a centerline to a gage;

a plurality of discrete, mutually separated posts comprising a particulate abrasive material protruding upwardly from the face, wherein the plurality of posts include bases of larger cross-sectional area than outermost ends thereof, wherein the base of at least one of the plurality of posts exhibits a noncircular cross-sectional area.

25. The rotary drag bit of claim 24, wherein the posts are integrally formed with the bit face.

26. The rotary drag bit of claim 25, wherein the bit body comprises a matrix bit body.

27. The rotary drag bit of claim 24, further comprising a plurality of blades on the face extending generally radially outwardly toward the gage, each blade having at least one of the plurality of posts positioned thereon.

28. The rotary drag bit of claim 27, wherein the posts are integrally formed with the blades.

29. The rotary drag bit of claim 28, wherein the blades extend radially outwardly over the bit face in substantially linear fashion.

30. The rotary drag bit of claim 28, wherein the blades extend radially outwardly in spiral fashion.

31. The rotary drag bit of claim 28, wherein the blades extend radially outwardly in a serpentine fashion.

32. The rotary drag bit of claim 24, further comprising a cone portion formed on the face and surrounding the centerline and a plurality of polycrystalline diamond compact (PDC) cutters disposed on the face within the cone portion.

33. The rotary drag bit of claim 32, wherein the plurality of PDC cutters are oriented with cutting faces substantially facing in a direction of intended bit rotation.

34. A method of forming a rotary drill bit for drilling a subterranean formation, comprising:

forming a body having a centerline and a face extending from a centerline to a gage;

forming a plurality of discrete, mutually separated cutting structures impregnated with a particulate abrasive material and protruding upwardly from the face, each cutting structure having a base with a larger cross sectional area than the outer most ends thereof; and forming the base of at least one of the plurality of discrete, mutually spaced cutting structures to exhibit a noncircular cross-sectional area.

35. The method of claim 34, further comprising configuring a plurality of blades on the face to extend generally radially outwardly toward the gage wherein the plurality of cutting structures are located on the plurality of blades.

36. The method of claim 35, further comprising forming the bit body with a metal matrix material.

37. The method of claim 36, further comprising integrally forming the plurality of discrete, mutually separated cutting structures with the blades.

38. The method of claim 37, further comprising:

forming a cone portion in the face of the body and surrounding the centerline; and disposing a plurality of polycrystalline diamond compact (PDC) cutters on the face within the cone portion.

39. The method of claim 35, further comprising configuring the plurality of blades to provide at least one fluid course therebetween.

40. The method of claim 39, further comprising placing a plurality of ports in the face of the drill bit, each port being in fluid communication with at least one of the plurality of fluid courses.

41. The method of claim 34, further comprising:

forming a cone portion in the face of the body and surrounding the centerline; and disposing a plurality of polycrystalline diamond compact (PDC) cutters on the face within the cone portion.

42. The method of claim 34, further comprising forming the bit body as a matrix bit body.

43. The method of claim 42, further comprising forming the cutting structures as posts.

44. The method of claim 43, further comprising integrally forming the posts with the face.

45. The method of claim 34, further comprising configuring each cutting structure to have a substantially planar surface at the outermost end thereof, each substantially planar surface being substantially parallel with the bit face from which the cutting structure protrudes.

46. A method of drilling a subterranean formation with a diamond impregnated matrix body rotary drill bit comprising:

providing a plurality of discrete, mutually separated post-like structures on each of a plurality of blades on a face of the rotary drill bit, the plurality of discrete post-like structures containing diamond grit;

rotating the rotary drill bit against at least a first subterranean formation under weight on bit and engaging the at least first subterranean formation with the plurality of discrete post-like structures wearing a portion of at least one discrete post-like structures of the plurality as it is engaged with the at least first subterranean formation such that it exposes diamond grit contained in the at least one discrete post-like structure and enlarging a surface area of the at least one discrete post-like structure as it wears against the at least first formation such that an increasing surface area including diamond grit is exposed.

47. The method of claim 46, further comprising wearing the plurality of discrete post-like structures down to the blades and continuing to engage the at least a first formation with diamond grit carried in the blades.

48. A rotary drag bit for drilling subterranean formations, comprising:

a bit body having a face extending from a centerline to a gage, the face including a cone portion surrounding the centerline;

a plurality of blades on the face extending generally radially outwardly toward the gage;

a plurality of discrete, mutually separated cutting structures comprising a particulate abrasive material protruding upwardly from each of the blades; and a plurality of polycrystalline diamond compact (PDC) cutters disposed on the face within the cone portion, wherein the discrete cutting structures are configured as posts, the posts including bases of larger cross-sectional area than outermost ends thereof and wherein the posts taper from substantially circular outermost ends to substantially oval bases.

49. A rotary drag bit for drilling subterranean formations, comprising:

a bit body having a face extending from a centerline to a gage, the face including a cone portion surrounding the centerline;

a plurality of blades on the face extending generally radially outwardly toward the gage;

a plurality of discrete, mutually separated cutting structures comprising a particulate abrasive material protruding upwardly from each of the blades; and a plurality of polycrystalline diamond compact (PDC) cutters disposed on the face within the cone portion, wherein at least one of the plurality of discrete cutting structures is formed as a hot isostatic segment.

50. The rotary drag bit of claim 49, wherein the at least one discrete cutting structure is brazed onto the blade.

51. A rotary drag bit for drilling subterranean formations, comprising:

a bit body having a face extending from a centerline to a gage, the face including a cone portion surrounding the centerline;

a plurality of blades on the face extending generally radially outwardly toward the gage;

a plurality of discrete, mutually separated cutting structures comprising a particulate abrasive material protruding upwardly from each of the blades; and a plurality of polycrystalline diamond compact (PDC) cutters disposed on the face within the cone portion, wherein the bit body comprises a matrix bit body, and the blades are integral with the bit body, the discrete cutting structures are integral with the blades and the bit body, and wherein the discrete cutting structures are comprised of a metal matrix material carrying the diamond grit and at least a portion of the blades is comprised of a softer and more abradable metal matrix material than that of the metal matrix material present in bases of the blades.

52. A rotary drag bit for drilling subterranean formations, comprising:

a bit body having a face extending from a centerline to a gage, the face including a cone portion surrounding the centerline;

a plurality of blades on the face extending generally radially outwardly toward the gage;

a plurality of discrete, mutually separated cutting structures comprising a particulate abrasive material protruding upwardly from each of the blades; and a plurality of polycrystalline diamond compact (PDC) cutters disposed on the face within the cone portion, wherein the bit body comprises a matrix bit body, the blades are integral with the bit body, and wherein the discrete cutting structures are brazed onto the blades.

53. A rotary drag bit for drilling subterranean formations, comprising:

a bit body having a face extending from a centerline to a gage, the face including a cone portion surrounding the centerline;

a plurality of blades on the face extending generally radially outwardly toward the gage;

a plurality of discrete, mutually separated cutting structures comprising a particulate abrasive material protruding upwardly from each of the blades; and a plurality of polycrystalline diamond compact (PDC) cutters disposed on the face within the cone portion, wherein the bit body comprises a matrix bit body, the blades are integral with the bit body, and wherein the discrete cutting structures are furnaced onto the blades.

54. A rotary drag bit for drilling subterranean formations, comprising:

a bit body having a face extending from a centerline to a gage, the face including a cone portion surrounding the centerline;

a plurality of blades on the face extending generally radially outwardly toward the gage;

a plurality of discrete, mutually separated cutting structures comprising a particulate abrasive material protruding upwardly from each of the blades; and a plurality of polycrystalline diamond compact (PDC) cutters disposed on the face within the cone portion, wherein the PDC cutters are oriented with cutting faces substantially facing in a direction of intended bit rotation and wherein the PDC cutters include PDC sheaths contiguous with, and extending to the rear of, the cutting faces, taken in the direction of intended bit rotation, extending over substrates of the PDC cutters.

* * * * *